US010788060B2

(12) United States Patent
Hanna

(10) Patent No.: US 10,788,060 B2
(45) Date of Patent: Sep. 29, 2020

(54) CYLINDER OCCUPYING STRUCTURE

(71) Applicant: Ibrahim Mounir Hanna, Miami, FL (US)

(72) Inventor: Ibrahim Mounir Hanna, Miami, FL (US)

( * ) Notice: Subject to any disclaimer, the term of this patent is extended or adjusted under 35 U.S.C. 154(b) by 184 days.

(21) Appl. No.: 15/847,711

(22) Filed: Dec. 19, 2017

(65) Prior Publication Data

US 2019/0186508 A1 Jun. 20, 2019

(51) Int. Cl.

| | |
|---|---|
| ***F02B 33/04*** | (2006.01) |
| ***F15B 15/20*** | (2006.01) |
| ***F15B 15/14*** | (2006.01) |
| ***F02B 75/04*** | (2006.01) |

(52) U.S. Cl.
CPC ..... *F15B 15/204* (2013.01); *F02B 75/042* (2013.01); *F15B 15/1428* (2013.01)

(58) Field of Classification Search
CPC ..... F02D 15/04; F02B 75/042; F02B 75/28
USPC ..... 123/73 C
See application file for complete search history.

(56) References Cited

U.S. PATENT DOCUMENTS 741,824 A 10/1903 Pehrsson
1,167,023 A * 1/1916 Schmidt ..... F02B 75/042 123/78 AA
1,564,009 A * 12/1925 Myers ..... F01L 5/045 123/78 A
1,574,062 A * 2/1926 Boehmer ..... F02B 75/28 123/65 V
2,445,148 A * 7/1948 Minnix ..... F01L 1/44 123/66
2,883,974 A * 4/1959 Heising ..... F02D 15/04 123/48 AA
3,139,074 A * 6/1964 Winn ..... F02B 75/28 123/51 BC
3,312,206 A * 4/1967 Radovic ..... F01B 7/02 123/78 D
3,981,276 A 9/1976 Ernest
4,169,435 A * 10/1979 Faulconer, Jr. ..... F02B 75/042 123/48 A
4,446,833 A 5/1984 Matsushita et al.
4,516,537 A * 5/1985 Nakahara ..... F02D 15/04 123/48 AA
4,949,541 A 8/1990 de Vietro
4,998,511 A 3/1991 Van Avermaete
5,211,145 A 5/1993 Ichikawa et al.
5,341,771 A * 8/1994 Riley ..... F02B 41/04 123/316
5,379,732 A 1/1995 Mavinahally et al.
6,354,250 B1 * 3/2002 Rodriguez Lopez ..... F02B 75/041 123/48 A (Continued)

*Primary Examiner* — Long T Tran
*Assistant Examiner* — James J Kim
(74) *Attorney, Agent, or Firm* — John Rizvi; John Rizvi P.A.—Rizvi-The Patent Professor

(57) ABSTRACT

Implementations are disclosed herein that relate to a cylinder occupying structure. An example provides a cylinder system comprising a mechanical cylinder including an internal space in which a fluid is introduced, and a piston configured for reciprocating motion in the internal space, and a cylinder occupying structure including an insertion rod, wherein the insertion rod is variably inserted into, and retracted from, the internal space of the cylinder in correspondence with the reciprocating motion of the piston.

20 Claims, 9 Drawing Sheets

(56) References Cited

U.S. PATENT DOCUMENTS

| | | | | |
|---|---|---|---|---|
| 6,427,643 | B1 * | 8/2002 | Dixon | F02B 19/06 123/48 A |
| 7,341,041 | B2 | 3/2008 | Pekau | |
| 8,523,547 | B2 | 9/2013 | Pekrul | |
| 9,057,267 | B2 | 6/2015 | Pekrul | |
| 9,239,003 | B1 * | 1/2016 | Manke | F02B 75/042 |
| 2015/0322976 | A1 * | 11/2015 | Rabhi | F15B 15/17 60/591 |

* cited by examiner

CYLINDER OCCUPYING STRUCTURE

FIELD OF THE INVENTION

The present invention relates generally to mechanical devices used to perform work, and more particularly to hydraulic and combustion cylinders.

BACKGROUND OF THE INVENTION

A wide variety of devices utilize cylinders to perform mechanical functions and produce useful work. A typical internal combustion engine (ICE), for example, employs a number of cylinders in which a fuel-air mixture is compressed and combusted to produce work that is imparted to a respective reciprocating piston. Each piston may be coupled to a crankshaft, with which forces imparted to the pistons can be transmitted, through various intermediate devices, to the wheels of a vehicle to thereby propel the vehicle.

Non-ICE engines and other devices may utilize cylinders in producing work. A hydraulic system, for example, may employ a cylinder having a piston operable to push hydraulic fluid in the cylinder, where pressure applied to the hydraulic fluid by the piston can be transmitted to other components in the hydraulic system in accordance with Pascal's principle. As a specific example, a hydraulic lift may employ two hydraulic cylinders in fluidic communication to obtain a multiplication in output force: an output cylinder used to lift an object such as a vehicle may be configured with a larger area throughout which the output force is distributed so as to multiply the input force applied to an input cylinder having a relatively smaller area throughout which the input force is applied.

When configured for use in an ICE, hydraulic system, or in other contexts, a typical cylinder produces output (e.g., power, force) that is proportional to its stroke volume (e.g., the volume through which a piston surface travels) and stroke distance (e.g., the axial distance through which the piston surface travels). Accordingly, previous systems (e.g., gasoline and diesel ICEs) have turned to increased stroke volumes and/or distances to increase cylinder output. Increasing stroke volume and/or distance may stipulate an increase in cylinder dimensions and thus cylinder mass, however, reducing the overall economy of an engine and vehicle in which such enlarged cylinders are used. Other approaches to increasing engine/vehicle economy may include the use of a recovery system. Hydraulic cylinders, for example, may be coupled to a hydraulic or electrical recovery system, though such recovery systems frequently exhibit limited efficiencies (e.g., 20-30%). In the case of a hydraulic recovery system, in which unused mechanical forces may be redirected to pump fluids into a pressure accumulating storage chamber for later cylinder intake, the operating fluid intake may be originally accumulated under low efficiency recycling methods based on pumping against high head accumulators. While pressurized fluid input or cylinder input pressure can be reduced to increase overall hydraulic system efficiency, cylinder output may correspondingly decrease, as in some configurations the output power of a hydraulic cylinder is proportional to the product of effective head pressure and fluid flow. Moreover, the limited efficiency of cylinder-based systems is further compounded when considering the energy expended in producing the fluids provided as input to a cylinder, such as the energy required to accumulate pressurized fluid for hydraulic cylinders, and the energy required to refine and transport combustible fuel for combustion cylinders.

In view of the above, there exists a need for a mechanism to increase the output of a cylinder output without altering attributes of the cylinder, such as stroke volume, stroke length, or the volume of the cylinder itself.

SUMMARY OF THE INVENTION

This summary is provided to introduce a selection of concepts in a simplified form that are further described below in the detailed description. This summary is not intended to identify key features of essential features of the claimed subject matter, nor is it intended to be used to limit the scope of the claimed subject matter. Furthermore, the claimed subject matter is not limited to implementations that solve any or all disadvantages noted in any part of this disclosure.

According to embodiments of the present disclosure, a cylinder system is disclosed, the cylinder system comprising a mechanical cylinder including an internal space in which a fluid is introduced, and a piston configured for reciprocating motion in the internal space; and a cylinder occupying structure including an insertion rod, wherein the insertion rod is variably inserted into, and retracted from, the internal space of the cylinder in correspondence with the reciprocating motion of the piston.

In another aspect, the insertion rod displaces a portion of the internal space, such that a volume of the internal space occupied by the fluid is less than an intrinsic volume of the internal space.

In another aspect, the insertion rod reduces a fluid intake corresponding to a given stroke of the piston.

In another aspect, the cylinder system further comprises a controller configured to control the cylinder occupying structure via an electromagnetic actuator.

In another aspect, the electromagnetic actuator includes an electrical system configured to supply current to a coil and thereby generate a magnetic field.

In another aspect, the magnetic field interacts with a permanent magnet in the insertion rod to variably insert the insertion rod into, or remove the insertion rod from, the internal space of the cylinder.

In another aspect, the insertion rod is variably inserted into, and retracted from, the internal space of the cylinder via a mechanical actuator.

In another aspect, the mechanical actuator includes a spring that converts kinetic energy of the insertion rod into potential energy of the spring.

In another aspect, the insertion rod is inserted into the internal space of the cylinder during an expansion stroke of the cylinder, and the insertion rod is retracted from the internal space of the cylinder during a compression stroke of the cylinder.

In another aspect, the cylinder is a hydraulic cylinder, and the fluid is a hydraulic fluid.

In another aspect, the cylinder is a combustion cylinder, and the fluid is a combustible fluid.

In another aspect, the insertion rod undergoes motion at a substantially same rate and a substantially same direction as the piston.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the claimed subject matter will hereinafter be described in conjunction with the appended drawings provided to illustrate and not to limit the scope of the claimed subject matter, where like designations denote like elements, and in which:

It is to be understood that like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Disclosed is a cylinder occupying structure. An example provides a cylinder system comprising a mechanical cylinder including an internal space in which a fluid is introduced, and a piston configured for reciprocating motion in the internal space, and a cylinder occupying structure including an insertion rod, wherein the insertion rod is variably inserted into, and retracted from, the internal space of the cylinder in correspondence with the reciprocating motion of the piston.

Figure 1:
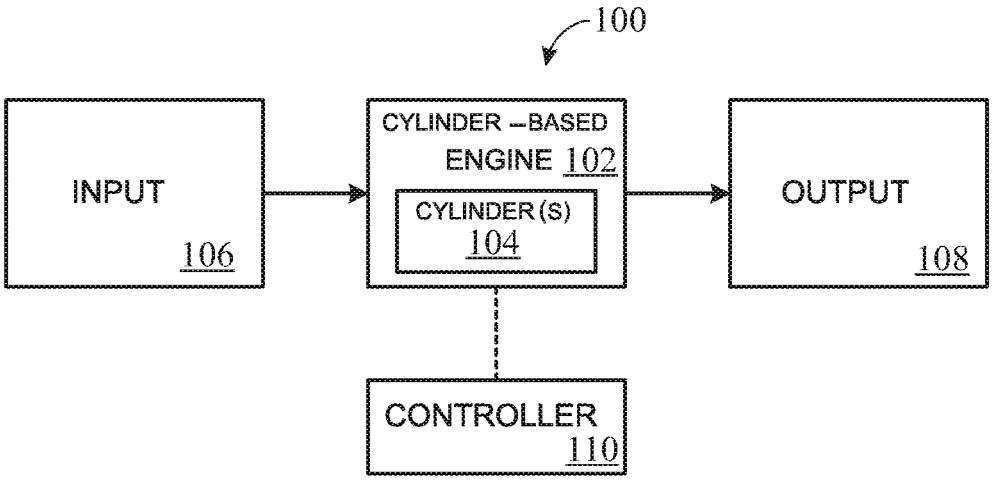
FIG. 1 presents an exemplary system that employs a cylinder-based engine 102 to produce useful work.

The illustration of FIG. 1 presents an exemplary system 100 that employs a cylinder-based engine 102 to produce useful work. As non-limiting examples, engine 102 may be utilized to propel a vehicle; including but not limited to seafaring vessels, wheeled vehicles, and aircraft; actuate various devices, such as hydraulic lifts, forklift arms, and backhoe arms, among other components of excavating devices and industrial machinery; and/or for any other suitable purpose. The illustration of FIG. 1 schematically shows the inclusion in engine 102 of one or more cylinders 104, with which useful work may be derived to perform such functions.

In some examples, engine 102 may be an internal combustion engine (ICE) configured produce useful work by combusting fuel in cylinder(s) 104. Cylinder(s) 104 may be arranged in any suitable configuration (e.g., I-4, V6, V8, V12). While not shown in the illustration of FIG. 1, in some examples engine 102 may be assisted by an electrical system comprising an energy source (e.g., battery) and a motor operatively coupled to one or more wheels of a vehicle in which the engine may be implemented. Such a configuration may be referred to as a "hybrid" configuration, and may employ techniques such as regenerative braking to charge the energy source.

Cylinder(s) 104 may include pistons that undergo reciprocating motion caused by fuel combustion therein. In some examples, the reciprocating piston motion may be converted to rotational motion of a crankshaft, which may be coupled to one or more vehicle wheels via a transmission to thereby provide vehicle propulsion. In other examples, the reciprocating piston motion may be converted to other components and/or other forms of motion, including but not limited to articulation of an arm of an industrial vehicle (e.g., forklift, backhoe) and linear actuation. To this end, the illustration of FIG. 1 shows an output 108 produced by engine 102, which may include the rotational motion, articulation, or actuation described above, or any other suitable output.

An intake passage may be pneumatically coupled to engine 102 to provide intake air to the engine, enabling mixing of the air with fuel to thereby form charge air for in-cylinder combustion. To this end, the illustration of FIG. 1 shows the reception at engine 102 of an input 106, which may comprise the fuel/air mixture. Input 106 may include any suitable combination of fuels, including but not limited to gasoline, diesel, nitrous oxide, ethanol, and natural gas. An intake throttle may be arranged in the intake passage and configured to variably control the air ingested into engine 102—e.g., as a function of mass airflow, volume, pressure. The intake passage may include various components, including but not limited to a charge air cooler, a compressor (e.g., of a turbocharger or supercharger), an intake manifold, etc. Respective intake valves may variably control the ingestion of charge air into cylinder(s) 104. A fuel system may be provided for storing and supplying the fuel(s) supplied to engine 102.

An exhaust passage may be pneumatically coupled to engine 102 to provide a path by which the products of charge air combustion are exhausted from the engine and to the surrounding environment. Various aftertreatment devices may be arranged in the exhaust passage to treat exhaust gasses, including but not limited to a NOx trap, particulate filter, catalyst, etc. For implementations in which engine 102 is boosted via a turbocharger, a turbine may be arranged in the exhaust passage to drive the turbocharger compressor. Respective exhaust valves may variably control the expulsion of exhaust gasses from cylinder(s) 104.

A controller 110 may be operatively coupled to various components in engine 102 for receiving sensor input, actuating devices, and generally effecting operation of the engine. As such, controller 110 may be referred to as an "engine control unit" (ECU). As examples, ECU may receive one or more of the following inputs: throttle position, barometric pressure, transmission operating gear, engine temperature, and engine speed. As described in further detail below, controller 110 may control the operation of a cylinder operation structure that is variably introduced into the internal space of cylinder(s) 104 in accordance with the operating cycle of the cylinder(s).

Controller 110 may be implemented in any suitable manner. As an example, controller 110 may include a logic machine and a storage machine holding machine-readable instructions executable by the logic machine to effect the approaches described herein. The logic machine may be implemented as a controller, processor, system-on-a-chip (SoC), etc. The storage machine may be implemented as read-only memory (ROM, such as electronically-erasable-programmable ROM), and may comprise random-access memory (RAM). Controller 110 may include an input/output (I/O) interface for receiving inputs and issuing outputs (e.g., control signals for actuating components).

Engine 102 may assume other forms. For example, engine 102 may be configured for hydraulic operation, where cylinder(s) 104 include respective pistons that undergo reciprocating motion to variably compress a hydraulic fluid therein. In this example, input 106 may include a hydraulic fluid that is supplied to cylinder(s) 104, such as oil, water, and/or any other suitable fluid(s). Output 108 may include rotational motion, articulation, actuation, or any other suitable type of mechanical output. Alternatively or in addition to mechanical output, output 108 may be considered to include hydraulic fluid that is pressurized by cylinder(s) 104, where the pressure applied by the cylinders may be transmitted to hydraulic fluid in other components that are in at least partial fluidic communication with the cylinders. Such hydraulic output may in turn be utilized to generate mechanical output, as in a hydraulic lift, for example. For implementations in which engine 102 is configured for hydraulic operation, the engine, and/or other elements that may form a hydraulic circuit, may include any suitable combination of hydraulic components, including but not limited to a pump, valve, accumulator, reservoir, filter, etc. In such implementations, controller 110 may be configured to control the operation of hydraulic cylinder(s) 104, engine 102, and/or other components of a hydraulic circuit, based on any suitable sensor output(s) (e.g., pressure, valve state, flow rate).

Figure 2A:
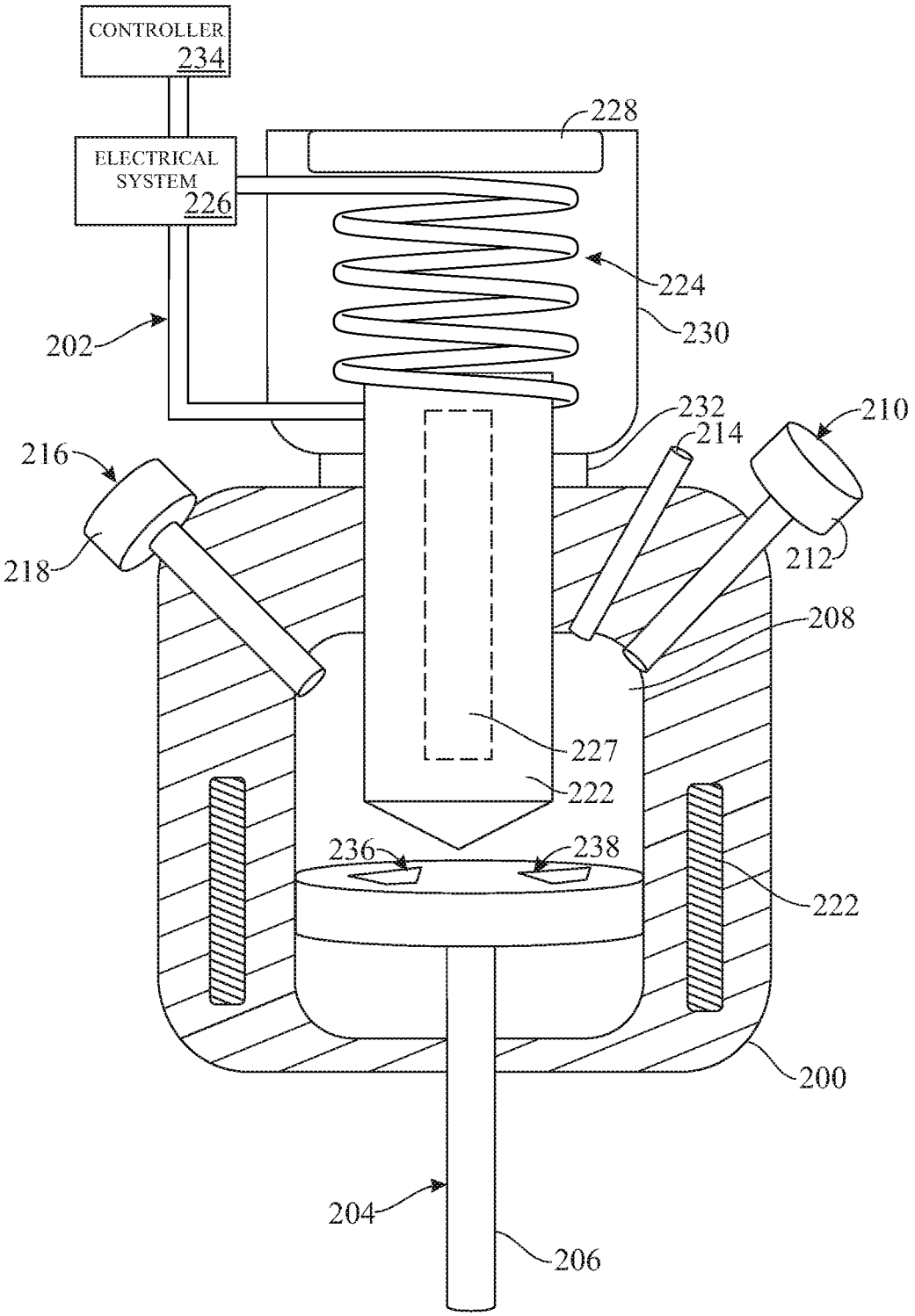
FIGS. 2A-2B show respective states of a combustion cylinder including an exemplary electromagnetic implementation of a cylinder occupying structure.
Figure 2B:
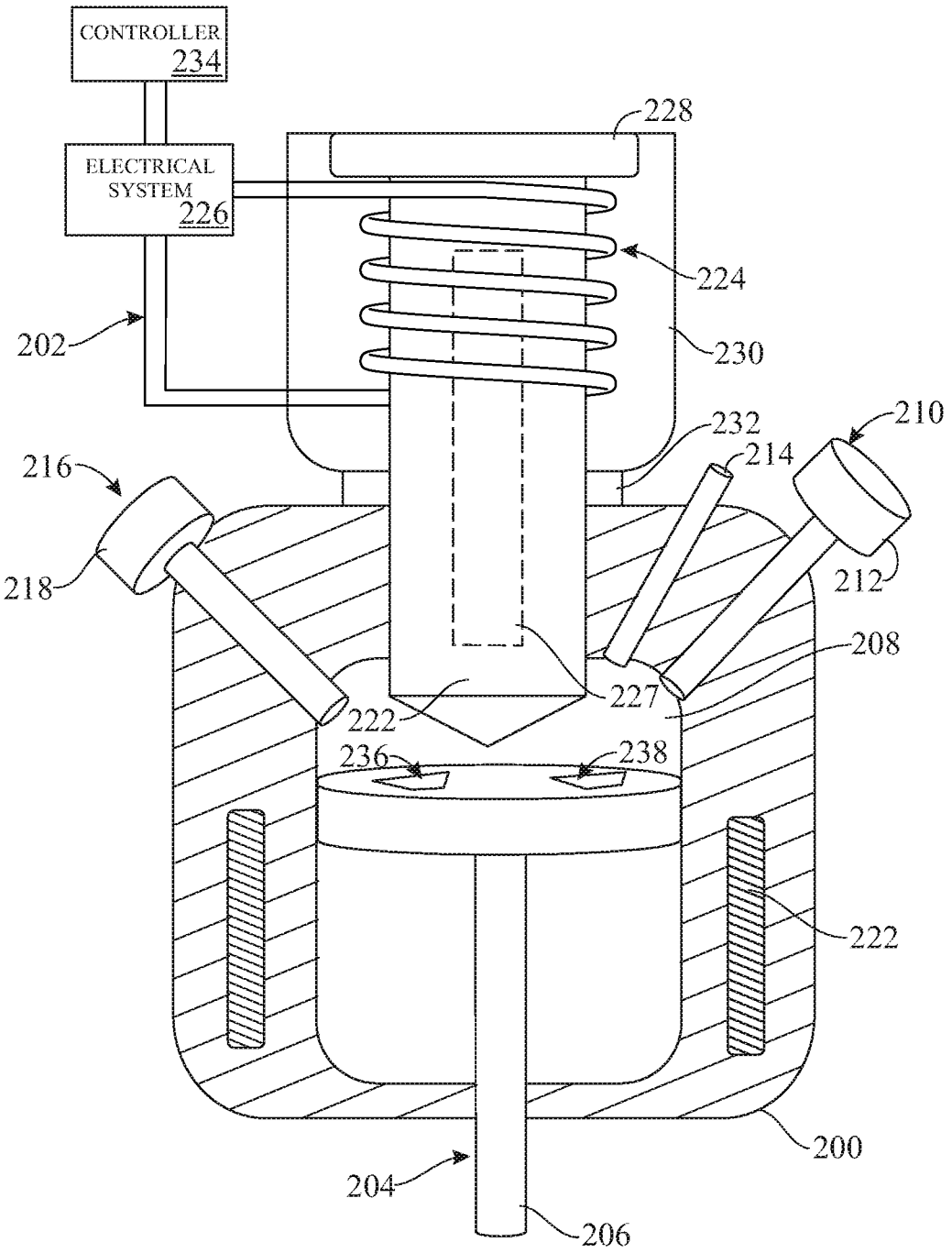
Figure 3A:
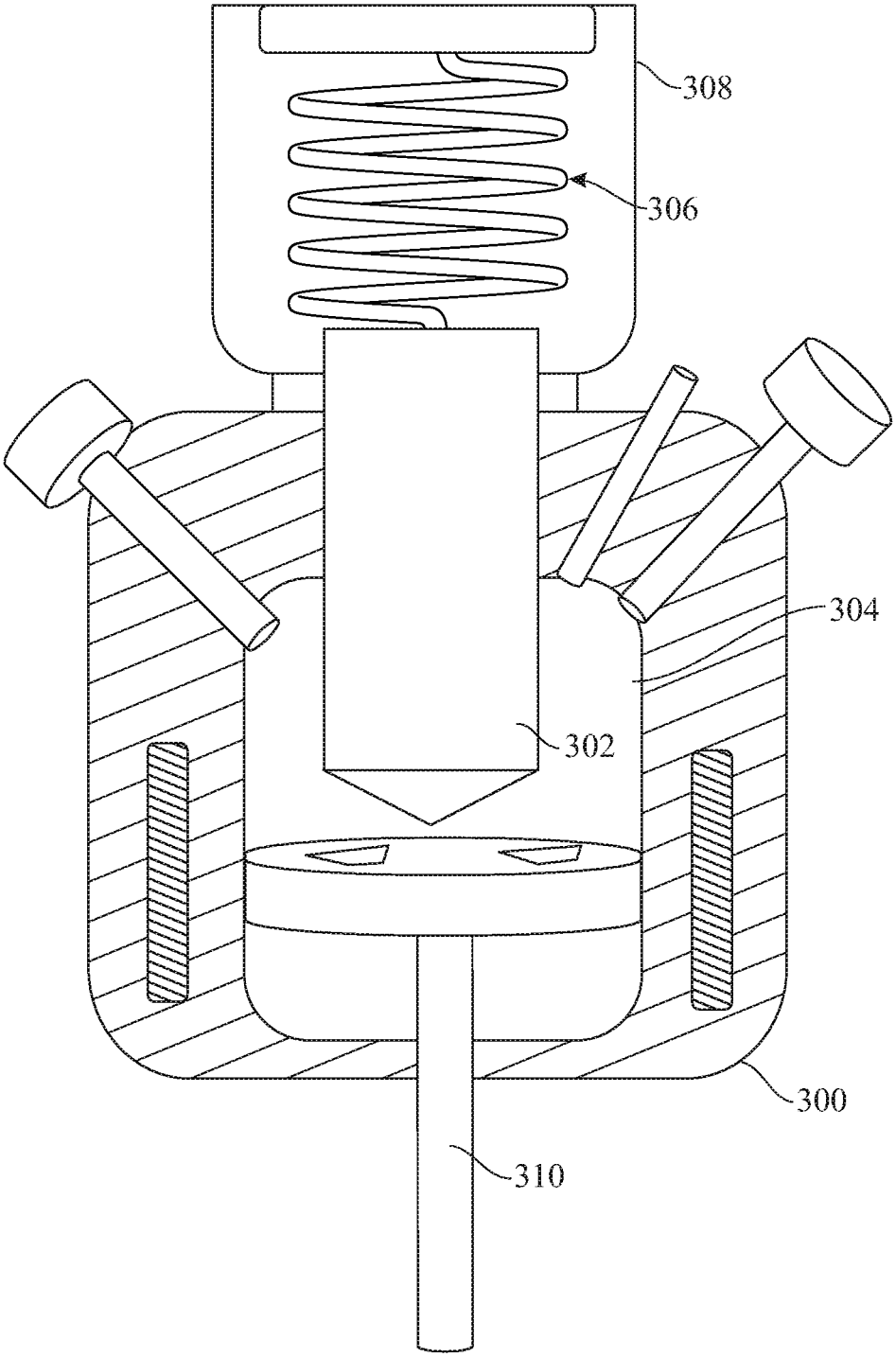
FIGS. 3A-3B show respective states of a combustion cylinder including an exemplary mechanical implementation of a cylinder occupying structure.
Figure 3B:
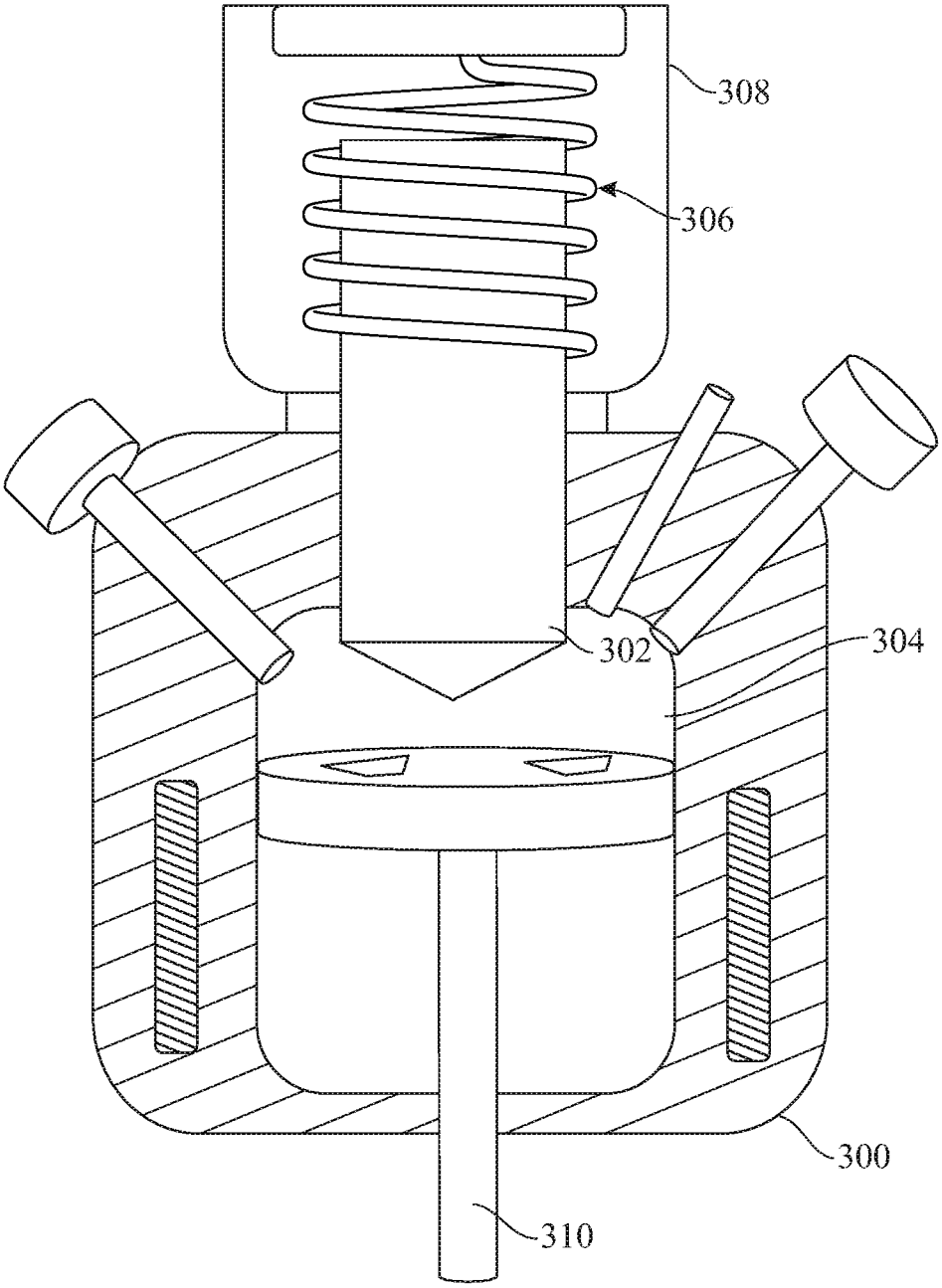
Figure 4:
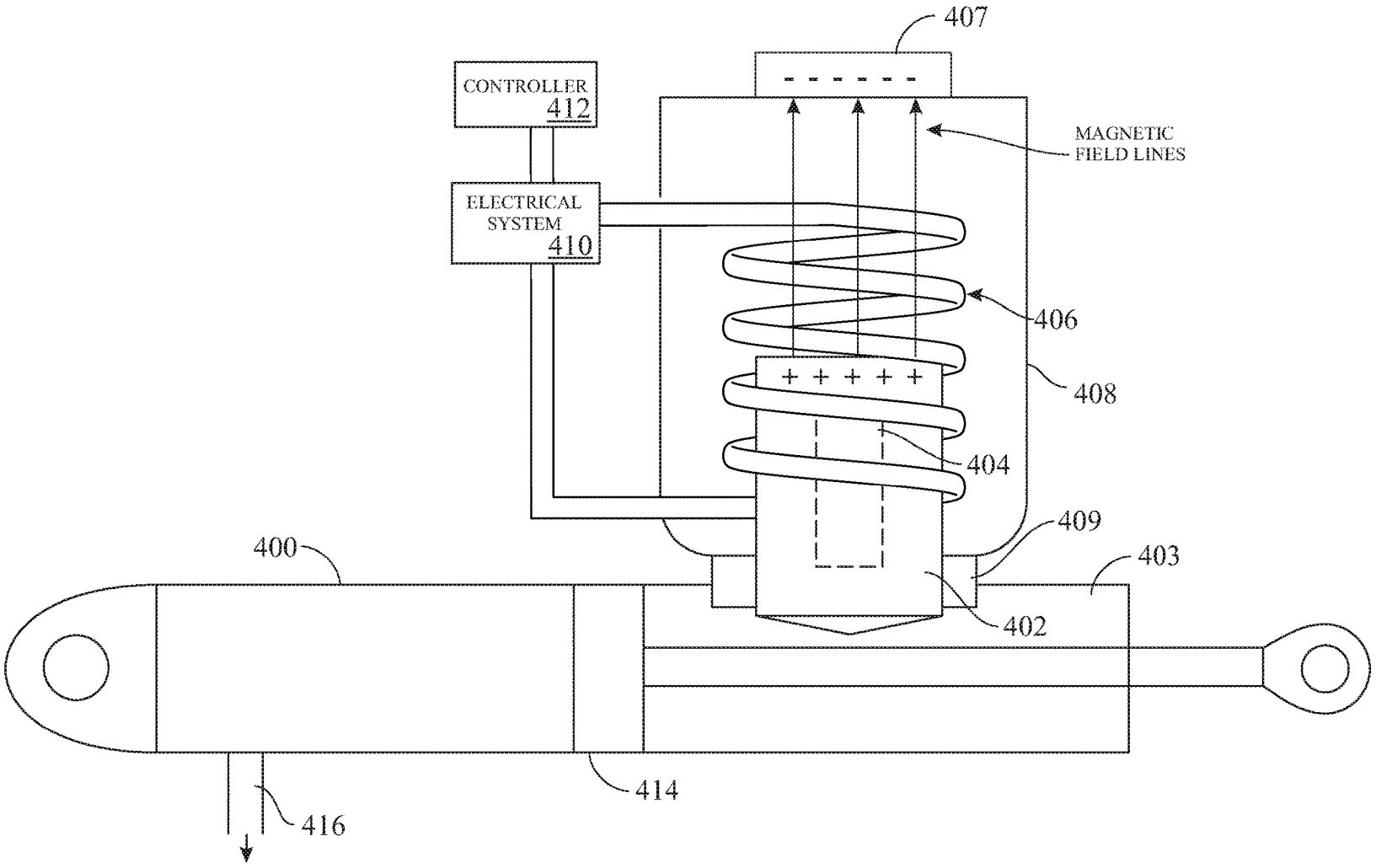
FIG. 4 shows an exemplary electromagnetic implementation of a cylinder occupying structure for a hydraulic cylinder.
Figure 5:
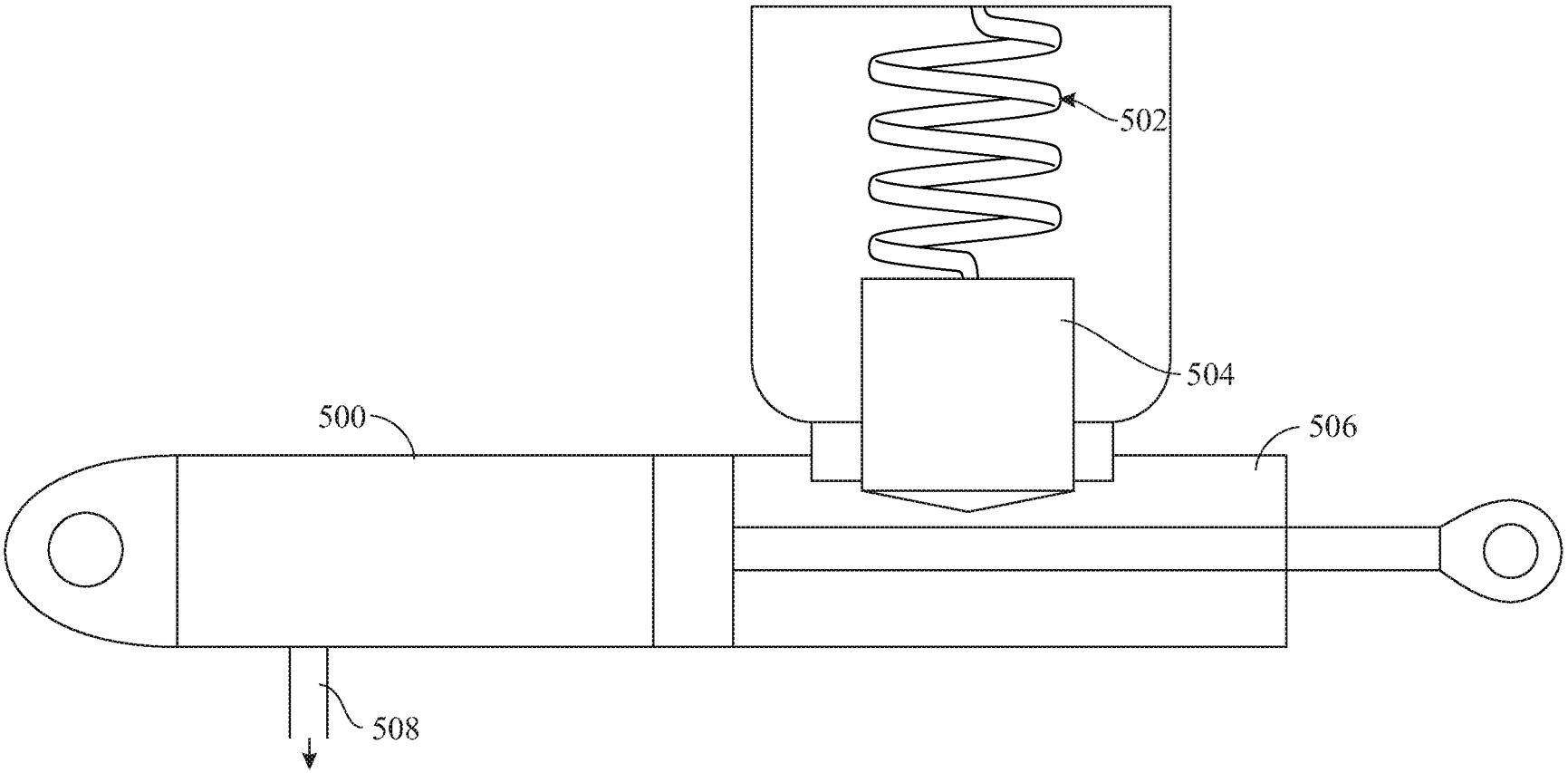
FIG. 5 shows an exemplary mechanical implementation of a cylinder occupying structure for a hydraulic cylinder.
Figure 6:
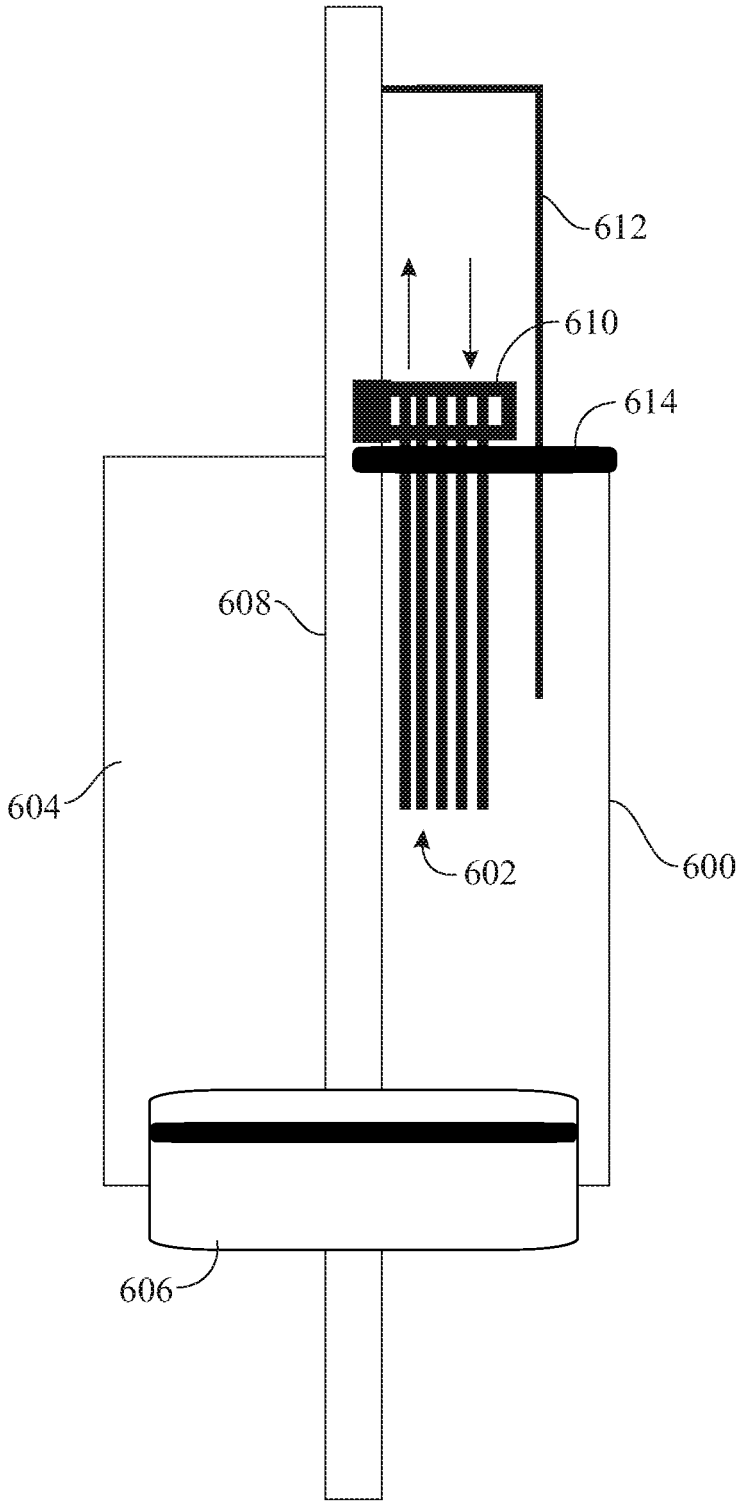
FIG. 6 shows another exemplary mechanical implementation of a cylinder occupying structure for a combustion cylinder.

To increase cylinder output and avoid the drawbacks described above associated with existing approaches to increasing cylinder output, cylinder(s) 104 include a cylinder occupying structure that is variably inserted in, and removed from, the internal space of the cylinder(s) in which the operative fluid(s) (e.g., hydraulic fluid, combustible fuel) used to produce output are introduced. FIGS. 2A-2B show an exemplary electromagnetic implementation of the cylinder occupying structure for a combustion cylinder, FIGS. 3A-3B show an exemplary mechanical implementation of the cylinder occupying structure for a combustion cylinder, FIG. 4 shows an exemplary electromagnetic implementation of the cylinder occupying structure for a hydraulic cylinder, FIG. 5 shows an exemplary mechanical implementation of the cylinder occupying structure for a hydraulic cylinder, and FIG. 6 shows an alternative exemplary mechanical implementation of the cylinder occupying structure for a combustion cylinder. FIGS. 2-6 are not drawn to scale.

FIGS. 2A-2B show respective states of a combustion cylinder 200 including a cylinder occupying structure 202. In particular, FIG. 2A shows a cross-sectional view of cylinder 200 with a piston 204 oriented toward the bottom of its stroke, which may represent the beginning of a compression or exhaust stroke, for example. Piston 204 is coupled to a connecting rod 206, which may be coupled to another device such as a crankshaft to thereby translate reciprocating motion of the piston to rotational crankshaft motion or another form of motion, which in turn may be used to propel a vehicle, actuate a device, etc. Reciprocating motion of piston 204 may be caused by charge air combustion in an internal space 208 of cylinder 200. Combustion may be controlled in part by an intake valve 210 actuated via an intake camshaft 212, which is operable to selectively inject charge air into internal space 208 for compression and ignition therein. A spark or glow plug 214 may be controlled to cause ignition of injected charge air. Combustion products may be exhausted via an exhaust valve 216 actuated via an exhaust camshaft 218. To draw heat away from cylinder 200 in the course of charge air combustion, and thereby maintain desired operating temperatures and avoid thermal degradation, a coolant jacket 220 is arranged between the inner cylinder wall that defines internal space 208 and the outer cylinder wall that defines the exterior of the cylinder. A suitable coolant, which may comprise any suitable substance(s) such as water, antifreeze, etc., may be circulated through coolant jacket 220 via a cooling system. The cooling system may include a radiator that radiates heated coolant to an exterior environment, for example.

As described above, cylinder 200 includes a cylinder occupying structure 202 that is variably inserted into internal space 208 to increase cylinder output and efficiency. In particular, structure 202 includes an insertion rod 222 that is variably inserted into internal space 208 in correspondence with the reciprocating movement of piston 204. In some examples, insertion rod 222 may be progressively inserted into internal space 208 as piston 204 moves downward through the internal space. When cylinder 200 is configured to operate according to a two-stroke operating cycle, insertion rod 222 may be introduced into internal space 208 during the intake/combustion stroke, for example. When cylinder 200 is configured to operate according to a four-stroke operating cycle, insertion rod 222 may be introduced into internal space 208 during one or both of the intake and power/expansion stroke, for example. However, cylinder 200 may be configured according to any suitable operating cycle, based on which the introduction of insertion rod 222 into internal space 208 may be controlled. Generally, insertion rod 222 may be inserted into internal space 208 as piston 204 moves downward.

The illustration of FIG. 2B shows cylinder 200 with piston 204 positioned toward the top of internal space 208 and insertion rod 222 correspondingly retracted, which may represent a different stroke or portion of the operating cycle represented in FIG. 2A. For example, FIG. 2B may represent the state of cylinder 200 during a compression (e.g., for a two or four-stroke operating cycle) or exhaust stroke (e.g., for a four-stroke operating cycle). Taken together, FIGS. 2A-2B illustrate how insertion rod 222 may be variably inserted in and removed from internal space 208 in correspondence with movement of piston 204 downward and upward, respectively. The correspondence between movement of insertion rod 222 and piston 204 may assume any suitable form. In some examples, the movement of insertion rod 222 and piston 204 may be substantially synchronized, such that the insertion rod is actuated at substantially the same rate and direction as the piston. As piston 204 changes direction—i.e., stops moving upward or downward, and begins moving downward or upward, respectively—so too may insertion rod 222 accordingly change direction.

By placing insertion rod 222 in cylinder 200 during operating cycle portions in which a working fluid (e.g., hydraulic fluid, combustible fuel) is introduced into internal space 208, the volume of the internal space available to be occupied by the fluid is reduced by its partial occupancy by the insertion rod. The intrinsic volume of internal space 208 and cylinder 200 remains unchanged, however. In this way, the fluid mass introduced into cylinder 200 is reduced, without changing other cylinder parameters that affect cylinder output, such as stroke volume, stroke distance, stroke force, and piston surface area. Put another way, insertion rod 222 enables a reduction in the intake requirement of cylinder 200, and, as a result of its occupancy of internal space 208, the insertion rod further causes the volume of the internal space that is utilized in a combustion or hydraulic process—the so-called "combustion volume" or "hydraulic volume"-to be less than the intrinsic volume of the internal space itself. The intrinsic volume of cylinder 200 may be considered the volume defined by the inner walls of the cylinder, and in some contexts the volume above the upper surface of piston 204.

As described above, FIGS. 2A-2B depict an example electromagnetic implementation of cylinder occupying structure 202. In this implementation, insertion rod 222 is variably introduced into and removed from internal space 208 via a solenoid-type electromagnetic actuator comprising a coil 224 that is coupled at top and bottom ends to an electrical system 226. Coil 224 and insertion rod 222 are arranged such that the insertion rod is variably retracted within the internal of the coil, and substantially along the longitudinal axis of the coil. FIG. 2A represents how, in a fully or near-fully extended state in which insertion rod 222 extends into a large portion of internal space 208, the upper end of the insertion rod may remain within one or more wraps of coil 224, to thereby retain the ability to retract the insertion rod by electrically actuating the coil. Conversely, FIG. 2B represents how, in a fully or near-fully retracted state, the majority of the longitudinal extent of insertion rod 222 may be located within the internal space of coil 224. In this state, the tip of insertion rod 222 may protrude slightly into internal space 208, though the tip may be located in any suitable position relative to the internal space. Further, in this state an upper end of insertion rod 222 may contact a support 228 (FIG. 2B) provided in a housing 230, in which coil 224 and a portion of the insertion rod are arranged. An insulation barrier 232 is provided between the exterior wall of cylinder 200 and housing 230 to facilitate low-friction movement of insertion rod 222 between the internal space 208 and the housing, and also provide a substantial seal so that fluid injected into the internal space does not leak into the housing.

In this implementation, insertion rod 222 includes a magnet 227 (e.g., a permanent magnet) to enable interaction with magnetic fields generated by electrical currents transmitted through coil 224, and the solenoid-type electromagnetic extension and retraction of the insertion rod. Magnetic field lines produced by coil 224—specifically the portions thereof within the internal space of the coil below the upper end of the coil and above the lower end of the coil—may be substantially parallel with the direction in which insertion rod 222 extends and retracts. To facilitate the electromagnetic actuation of insertion rod 222 described herein, electrical system 226 may include a current source with which current is selectively provided to coil 224. Electrical system 226 is operatively coupled to a controller 234, which may control the electrical system to selectively position insertion rod 222 in accordance with the operating cycle of cylinder 200 as described above, and/or based on any other suitable inputs (e.g., camshaft timing, valve timing, intake or charge air variables, other operating conditions). In some examples, controller 234 may be controller 110 of FIG. 1. One or more of coil 224, electrical system 226, magnet 227, and controller 234 may form what is referred to herein as an "electromagnetic actuator". In some examples, the electromagnetic actuator may be considered a solenoid, where insertion rod 222 acts as a slug translated by the electromagnetic actuator.

Other electromagnetic configurations for actuating insertion rod 222 are contemplated. For example, cylinder occupying structure 202 may be configured with an electromagnetic actuator without a permanent magnet included in insertion rod 222, where electrical current is selectively applied to the electromagnetic actuator to variably generate a magnetic field. Further, in some examples retraction of insertion rod 222 may be assisted, or fully effected, via upward forces imparted to the insertion rod by fluid in internal space 208 that is pressurized by piston 204. Generally, any suitable electromagnetic mechanism may be used to actuate insertion rod 222.

Cylinder 200 may be configured with other aspects that increase cylinder output. As one example, FIGS. 2A-2B show the inclusion of surface features on a surface 236 of piston 204 in the form of a trapezoidal indentation 238. Surface features may assume any suitable geometry, however, and in other examples may be provided as protrusions extending above surface 236, rather than indentations. Such surface features may increase the torque force provided by piston 204, for example. Similarly, the geometry of insertion rod 222 may be configured to achieve various desired characteristics of cylinder 200. As one example, FIGS. 2A-2B show the tip of insertion rod 222 configured with a conical, extruded tip, though the tip and body of the insertion rod may assume any suitable form.

An internal surface of the piston may include dents and/or protrusions to increase the shear stress forces during a relative motion of the piston. Further, the internal surface of the piston may include a second lighter density metal to increase a distance between the gravity or weight center and the geometric center of the piston, providing partial advantage in the stroke distance relative to the cylinder internal space volume.

The illustration of FIGS. 3A-3B show an exemplary mechanical implementation of the cylinder occupying structure for a combustion cylinder 300. Aspects of cylinder 200 (e.g., valves, spark/glow plug, piston, coolant jacket, insertion rod) are shared by cylinder 300 and are not repeated in the description of FIGS. 3A-3B. Like cylinder 200, cylinder 300 includes an insertion rod 302 that is variably inserted into and retracted from an internal space 304 of cylinder 300 in accordance with the operating cycle of the cylinder. FIG. 3A shows cylinder 300 in a first stroke or portion of the operating cycle, such as an intake/combustion and/or power/expansion stroke, and FIG. 3B shows the cylinder in a second stroke or portion of the operating cycle, such as a compression or exhaust stroke.

As opposed to being electromagnetically actuated as in cylinder 200, insertion rod 302 is mechanically actuated via a spring 306 provided in a housing 308. Spring may be referred to herein as an "mechanical actuator". In this implementation, spring 306 may function as a transducer to convert kinetic energy (e.g., linear motion) of insertion rod 302 into potential energy of the spring (e.g., stored as spring compression), and to convert spring potential energy into insertion rod kinetic energy. Such conversion may be carried out cyclically so as to variably position insertion rod 302 into and out of internal space 304 in correspondence with movement of a piston 310. More specifically, FIG. 3A may represent a state in which insertion rod 302 begins to cease moving downward—effected at least in part by expansion of spring 306—and begins to move upward. Such upward motion may be effected by the initiation of contraction of spring 306, and also upward forces imparted to insertion rod 302 by fluid in internal space 304, where the fluid is pressurized via upward movement of piston 310. Kinetic energy associated with upward motion of insertion rod 302 is converted into potential energy associated with compression of spring 306 as the insertion rod moves upward, until the spring force opposing insertion rod motion reaches substantial equilibrium, at which point the spring may begin to expand and convert its potential energy into kinetic energy and motion of the insertion rod—e.g., as in the state represented in FIG. 3B. Various aspects of spring 306 may be configured to enable the corresponding motion of insertion rod 302 with piston 310, such as the spring's spring constant.

The illustration of FIG. 4 shows an electromagnetic implementation of the cylinder occupying structure for a hydraulic cylinder 400. Aspects of the electromagnetically actuated cylinder occupying structure of cylinder 200 are shared by cylinder 400 and are not repeated in the description of FIG. 4. In cylinder 400, an insertion rod 402 is variably inserted into and removed from an internal space 403 of the cylinder via interaction between a magnet 404 in the insertion rod and magnetic fields produced by a coil 406, in which the insertion rod undergoes opposing directions of linear motion. Coil 406 is arranged in a housing 408, which interfaces with an insulation barrier 409 that enables low-friction movement of insertion rod 402 and substantial sealing between internal space 403 and the housing. Coil 406 is electrically driven by an electrical system 410, which is coupled to a controller 412 (e.g., controller 110). As described above with reference to FIGS. 2A-2B, other electromagnetic actuators (e.g., those without the use of a magnet in insertion rod 402) may be used to drive the insertion rod.

The illustration of FIG. 4 also shows the system including a magnet 407 to create a magnetic field between a positively charged portion of the insertion rod 402 and the magnet 407. The magnetic field is shown via magnetic field lines. It is to be understood that the mechanical movement of the insertion rod is parallel with the magnetic field lines shown in FIG. 4. Therefore, a movement vector of the insertion rod 402 would not cross the magnetic field lines. The coil 406 provides another magnetic field responsible for controlling the reciprocal movement controls, while the coil or magnet 407 provides a field responsible for providing a driving force of the insertion rod 402. Therefore, in addition to the magnetic field provided by a solenoid, the system would also need to control the frequency of insertion rod movement, and the advancing force or the motion of the insertion rod may be gained from another field provided by magnet 407.

In contrast with cylinders 200 and 300, the direction in which insertion rod 402 undergoes motion is not aligned with the direction in which a piston 414 of cylinder 400 undergoes reciprocating motion. For example, the travelling direction of insertion rod 402 may be substantially perpendicular to the travelling direction of piston 414. However, insertion rod 402 provides a similar function to that of insertion rods 222 and 302: its occupancy in internal space 403 reduces the space that can be occupied by a hydraulic fluid relative to the intrinsic volume of the internal space, in turn reducing the fluid mass input to cylinder 400 and increasing cylinder output without modifying the stroke volume or distance of piston 414. Movement of insertion rod 402 may be controlled in correspondence with movement of piston 414. For example, insertion rod 402 may reach its lowest point substantially concurrently as piston 414 reaches its leftmost point (e.g., the bottom of its stroke), and the insertion rod may reach its highest point substantially concurrently as the piston reaches its rightmost (e.g., the top of its stroke). Cylinder 400 may provide any suitable output, which may comprise pressurized hydraulic fluid that is transmitted to any suitable component, such as another hydraulic cylinder or other hydraulic component, or a device that is actuated via the pressurized fluid. FIG. 4 generally represents this output in the form of a port 416 that is in fluidic communication with internal space 403 of cylinder 400.

The illustration of FIG. 5 shows a mechanical implementation of the cylinder occupying structure for a hydraulic cylinder 500. Aspects of the mechanically actuated cylinder occupying structure of cylinder 300, as well as aspects of cylinder 400, are shared by cylinder 500 and are not repeated in the description of FIG. 5. In this implementation, a spring 502 is coupled to an insertion rod 504 that is variably introduced into and retracted from an internal space 506 of cylinder 500. As with spring 306 described above, potential energy stored in spring 502 in the form of spring compression may be converted to kinetic energy and linear motion of insertion rod 504 into internal space 506, and kinetic energy of the insertion rod may be converted into spring potential energy and stored for subsequent insertions of the rod into the internal space. Pressurized hydraulic fluid output may be provided to other components via a port 508.

The illustration of FIG. 6 shows an alternative mechanical implementation of the cylinder occupying structure for a combustion cylinder 600. In this implementation, a plurality of rods or blades 602 are variably introduced into and removed from an internal space 604 of cylinder 600. Movement of blades 602 is synchronized (e.g., speed and direction) with movement of a piston 606 via the blades' attachment to a piston rod 608 through an attachment structure 610 coupled to the piston rod. A housing 612 provides a space in which blades 602 may be retracted during certain strokes or operating cycle portions of cylinder 600, and an insulating barrier 614 provides an interface between the housing and cylinder to enable low-friction movement of the blades and substantial sealing between the housing and cylinder. Insulating barrier 614 may include a hole for each blade 602, for example. Blades 602 may be configured in any suitable manner, including but not limited to the forms of rods, flat blades, curved blades, etc., and may have flat or sharp, pointed ends. Further, blades 602 may be positioned on one side of piston rod 608 as shown, but in other implementations may be distributed substantially evenly around the piston rod for balancing purposes. Blades 602 act to displace a portion of internal space 604 that would otherwise be available to a hydraulic or combustible fluid, to thereby reduce the fluid input to cylinder 600 without reducing the intrinsic volume of the internal space or modifying the stroke volume or distance of piston 606.

The cylinder occupying structure and cylinder implementations described herein are provided as examples and are not intended to be limiting in any way. Numerous modifications are within the scope of this disclosure. "Cylinder" as used herein does not require cylindrical geometry, but rather refers to a mechanical device in which reciprocating piston motion is used to produce useful work and output. Non-spherical geometries, such as hemispherical or wedged geometries may be employed, for example. Various cylinder components may be added, removed, or modified, including cylinder head components, valves, etc. Further, alternative insertion rod configurations are contemplated. For example, the insertion rods disclosed herein may enter a cylinder internal space from the bottom, side, or from any other direction, including at oblique angles. Still further, implementations are possible in which both spring-based and electromagnetic actuation is employed to control an insertion rod. In some hydraulic implementations, a hybrid solution may be employed in which fluid is mechanically pumped as well as magnetically advanced against a piston. For example, fluid may be pressed against a piston plunger without using a hydraulic pump during an active press.

The cylinder occupying structure implementations described herein may produce various technical effects and advantages. For example, the cylinder occupying structure may reduce the required fluid intake (e.g., fluid mass, fluid volume) into a cylinder (e.g., the required intake to perform a given stroke or travel a given stroke distance), where the required fluid intake is, in some contexts, initially stipulated by piston movement and shape. A reduced fluid intake may be used to maintain a similar stroke force relative to that associated with an initially larger fluid intake. In other examples, the cylinder occupying structure may allow using a similar fluid volume for a larger distance stroke. Further, the cylinder occupying structure may enable the application of a larger force per square inch on a piston's internal surface. In some examples, one or more insertion rods may add to a piston's effective surface area to increase force and power output. In some examples, such as those that employ electromagnetic actuation, the cylinder occupying structure may maintain combustion pressure magnitude, by holding an insertion rod steadily in place, with a magnetic field being initiated with fuel combustion. In some examples, the cylinder occupying structure may enable increases stroke distance and piston momentum via progressive rod insertion into a cylinder internal space. In some examples, the cylinder occupying structure may facilitate laminar piston movement with a slower pressure decline. In some examples, the cylinder occupying structure may enable an increase in power input magnitude from a static electric or static magnetic force. In some examples, the cylinder occupying structure may undergo motion parallel to magnetic field lines, without consuming electric power as long as an insertion rod does not cross the magnetic field lines. In some examples, such as those that employ mechanical spring-based actuation, the cylinder occupying structure may enable increased stroke distance, increased momentum, more laminar piston movement with decreased pressure variations, an increase of power input from insertion rod inertia and spring expansion momentum. In hydraulic implementations, an insertion rod may reduce the pressurized hydraulic fluid intake from a pump, as the fluid moved against a piston plunger is larger in mass than the pumped fluid. These and other technical effects may increase the economy of a vehicle in which the cylinder occupying structure is implemented.

Figure 7:
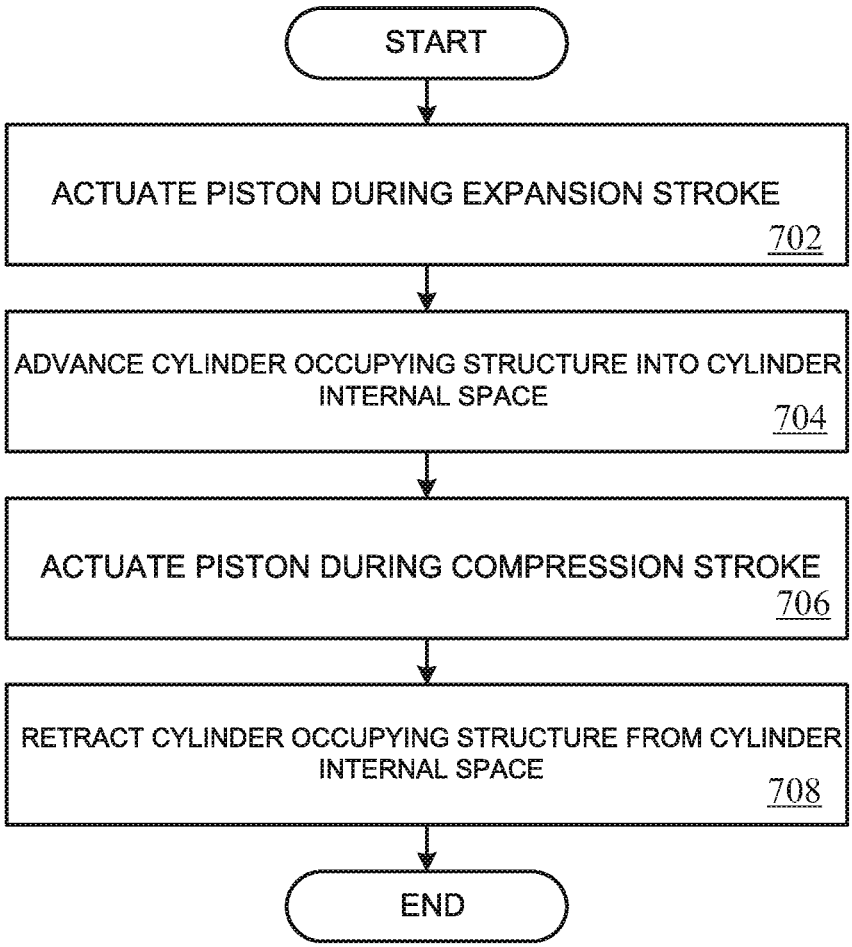
FIG. 7 shows a flowchart illustrating an exemplary method of using a cylinder occupying structure.

The illustration of FIG. 7 shows a flowchart illustrating an exemplary method 700 of using a cylinder occupying structure. The cylinder occupying structure may assume the form of one of insertion rod 222, 302, 402, 504, and blades 602, for example. The cylinder occupying structure may be used in conjunction with a hydraulic or combustion cylinder, such as cylinder 200, 300, 400, 500, 600, and/or 600, for example. Aspects relating to the control of the cylinder occupying structure may be carried out on a suitable controller, such as controller 110, 234, and/or 412, for example.

At 702, method 700 includes actuating a piston of a cylinder during an expansion stroke. Actuation of the piston during the expansion stroke may include moving the piston in a first direction that increases the portion of the internal space of the cylinder that can be occupied by an operative fluid (e.g., hydraulic fluid, combustible fuel). The expansion stroke may be an intake stroke, an induction stroke, a power stroke, or any other suitable stroke.

At 704, method 700 includes advancing the cylinder occupying structure into the internal space of the cylinder. The cylinder occupying structure may be advanced into the internal space of the cylinder in correspondence with the piston—e.g., in the first direction, during the expansion stroke and/or substantially synchronized with the piston, which may include advancement in the substantially same direction and/or speed as the piston.

At 706, method 700 includes actuating the piston during a compression stroke. Actuation of the piston during the compression stroke may include compressing the fluid occupying the internal space. The compression stroke may be a compression stroke, an exhaust stroke, or any other suitable stroke. The compression stroke may be an immediately subsequent stroke following the expansion stroke, or one or more other strokes may be carried out between the expansion and compression strokes. The piston may be actuated during the compression in a second direction that in some examples may be substantially opposite to the first direction in which the piston is actuated at 702.

At 708, method 700 includes retracting the cylinder occupying structure from the internal space of the cylinder. The cylinder occupying structure may be retracted from the internal space of the cylinder in correspondence with the piston—e.g., during the compression stroke and/or substantially synchronized with the piston, which may include retraction in the substantially same direction and/or speed as the piston.

Method 700 may be repeated throughout operation of the cylinder, at any suitable frequency, interval, duty cycle, etc., which may include continuous operation or may be interrupted (e.g., in response to controller input, operator input).

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A cylinder system, comprising:

a mechanical cylinder including an internal space in which a fluid is introduced, and a piston configured for reciprocating motion in the internal space; and a cylinder occupying structure including an insertion rod, wherein the insertion rod is variably inserted into, and retracted from, the internal space of the cylinder in correspondence with the reciprocating motion of the piston; and wherein the cylinder occupying structure is temporarily positioned within a stroke volume of the piston;

wherein the cylinder occupying structure is advanced into the internal space of the cylinder for at least some time during a power stroke of the piston, such that the cylinder occupying structure and the piston move in the same direction for at least some time during the power stroke;

wherein the cylinder occupying structure is retracted from the internal space of the cylinder for at least some time during a power stroke of the piston, such that the cylinder occupying structure and the piston move in opposite directions for at least some time during the power stroke;

wherein advancement and retraction of the cylinder occupying structure is done by a controller.

2. The cylinder system of claim 1, wherein the insertion rod displaces a portion of the internal space, such that a volume of the internal space occupied by the fluid is less than an intrinsic volume of the internal space, and such that inserting the cylinder occupying structure causes variation in a combustion chamber volume of the internal space during a combustion stroke.

3. The cylinder system of claim 1, wherein the insertion rod reduces a fluid intake corresponding to a given stroke of the piston.

4. The cylinder system of claim 1, further comprising a controller configured to control the cylinder occupying structure via an electromagnetic actuator.

5. The cylinder system of claim 4, wherein the electromagnetic actuator includes an electrical system configured to supply current to a coil and thereby generate a magnetic field.

6. The cylinder system of claim 5, wherein the magnetic field interacts with a permanent magnet in the insertion rod to variably insert the insertion rod into, or remove the insertion rod from, the internal space of the cylinder.

7. The cylinder system of claim 1, wherein the insertion rod is variably inserted into, and retracted from, the internal space of the cylinder via a force mechanism, the force mechanism being controlled independently with respect to forces applied to and forces resulting from the piston, the piston being a crankshaft piston.

8. The cylinder system of claim 7, wherein the mechanical actuator includes a spring that converts kinetic energy of the insertion rod into potential energy of the spring.

9. The cylinder system of claim 1, wherein the insertion rod is inserted into the internal space of the cylinder during an expansion stroke of the cylinder, and wherein the insertion rod is retracted from the internal space of the cylinder during a compression stroke of the cylinder;

wherein the insertion rod is variably inserted into, and retracted from, the internal space of the cylinder via a force mechanism, the force mechanism being controlled independently with respect to forces applied to and forces resulting from the piston, the piston being a crankshaft piston.

10. The cylinder system of claim 1, wherein the cylinder is a hydraulic cylinder, and wherein the fluid is a hydraulic fluid.

11. The cylinder system of claim 1, wherein the cylinder is a combustion cylinder, and wherein the fluid is a combustible fluid.

12. The cylinder system of claim 1, wherein the insertion rod undergoes motion at a substantially same rate and a substantially same direction as the piston; wherein the insertion rod is variably inserted into, and retracted from, the internal space of the cylinder via a force mechanism, the force mechanism being controlled independently with respect to forces applied to and forces resulting from the piston, the piston being a crankshaft piston.

13. At a mechanical cylinder system including a cylinder, a method, comprising:

actuating a piston of the cylinder during an expansion stroke in a first direction;

during the expansion stroke; advancing a cylinder occupying structure into an internal space of the cylinder in correspondence with motion of the piston;

actuating the piston of the cylinder during a compression stroke in a second direction substantially opposite to the first direction; and during the compression stroke, retracting the cylinder occupying structure from the internal space of the cylinder in correspondence with the motion of the piston; and wherein the cylinder occupying structure is temporarily positioned within a stroke volume of the piston;

wherein intake, compression, combustion, and power strokes all occur within no more than two strokes of the piston, by way of advancing and retracting the cylinder occupying structure at various times during the two strokes of the piston.

14. The method of claim 13, wherein the cylinder occupying structure is advanced and retracted via an electromagnetic actuator.

15. The method of claim 14, wherein the electromagnetic actuator includes an electrical system configured to supply current to one or more coils and thereby generate one or more magnetic fields.

16. The method of claim 13, wherein the cylinder occupying structure is advanced and retracted via a mechanical actuator wherein the cylinder occupying structure is variably inserted into, and retracted from, the internal space of the cylinder via a force mechanism, the force mechanism being controlled independently with respect to forces applied to and forces resulting from the piston, the piston being a crankshaft piston.

17. The method of claim 16, wherein the mechanical actuator includes a spring that converts kinetic energy of the insertion rod into potential energy of the spring.

18. The method of claim 13, wherein the cylinder is a combustion cylinder, the method further comprising injecting a combustible fuel into the cylinder prior to the compression stroke wherein the space occupying structure is variably inserted into, and retracted from, the internal space of the cylinder via a force mechanism, the force mechanism being controlled independently with respect to forces applied to and forces resulting from the piston the piston being a crankshaft piston.

19. The method of claim 13, wherein the cylinder is a hydraulic cylinder, the method further comprising compressing, via the cylinder, a hydraulic fluid during the compression stroke.

20. A cylinder system, comprising:

a mechanical cylinder including an internal space in which a fluid is introduced, and a piston configured for reciprocating motion in the internal space;

a cylinder occupying structure including an insertion rod, wherein the insertion rod is variably inserted in a first direction during an expansion stroke of the cylinder, and retracted from in a second direction substantially opposite the first direction during a compression stroke of the cylinder, the internal space of the cylinder in substantially synchronized correspondence with the reciprocating motion of the piston;

wherein the piston includes an internal surface having a course structure of at least one of dents and protrusions;

wherein the cylinder occupying structure is advanced and retracted by forces of at least one magnetic field without crossing magnetic lines of such at least one magnetic field;

wherein the cylinder occupying structure is advanced and retracted by a frequency controlled by the at least one magnetic field; and wherein the cylinder occupying structure is temporarily positioned within a stroke volume of the piston;

wherein the cylinder occupying structure is advanced into the internal space of the cylinder for at least some time during a power stroke of the piston, such that the cylinder occupying structure and the piston move in the same direction for at least some time during the power stroke;

wherein the cylinder occupying structure is retracted from the internal space of the cylinder for at least some time during a power stroke of the piston, such that the cylinder occupying structure and the piston move in opposite directions for at least some time during the power stroke;

wherein advancement and retraction of the cylinder occupying structure is done by a controller.

* * * * *